US006404704B1

(12) United States Patent
Bossel et al.

(10) Patent No.: US 6,404,704 B1
(45) Date of Patent: Jun. 11, 2002

(54) DIAL INCLUDING BRILLIANTS, APPLIQUES OR OTHER APPLIED ELEMENTS AND METHOD FOR SECURING SUCH ELEMENTS THERETO

(75) Inventors: Christophe Bossel, Yverdon; Erwin Koelbl, Villeret; Grégoire Iten, Uvrier/Saint-Léonard, all of (CH)

(73) Assignee: Eta SA Fabriques d'Ebauches, Grenchen (CH)

( * ) Notice: Subject to any disclaimer, the term of this patent is extended or adjusted under 35 U.S.C. 154(b) by 0 days.

(21) Appl. No.: 09/503,333

(22) Filed: Feb. 14, 2000

(30) Foreign Application Priority Data

Mar. 5, 1999 (CH) ..... 414/99

(51) Int. Cl.[7] ..... G04B 19/06
(52) U.S. Cl. ..... 368/232; 368/236
(58) Field of Search ..... 368/232, 228, 368/223

(56) References Cited

U.S. PATENT DOCUMENTS 3,197,846 A * 8/1965 Vogt ..... 368/232
3,433,013 A * 3/1969 Kohl et al. ..... 368/232

FOREIGN PATENT DOCUMENTS

| | | | | |
|---|---|---|---|---|
| CH | 33 104 | | 3/1905 | |
| DE | 19 43 075 A | | 3/1971 | |
| JP | 0127194 | * | 7/1983 | ..... 368/232 |
| WO | WO99/05233 | | 2/1999 | |

OTHER PUBLICATIONS

Patent Abstracts of Japan vol. 097 No. 009, Sep. 30, 1997 & JP 09 119986A (Seiko Instr Inc) May 6, 1997.

Patent Abstracts of Japan vol. 013 No. 485(M–887), Nov. 6, 1989 & JP 01 103169A (Tsuboman: KK) Aug. 3, 1989.

Patent Abstracts of Japan vol. 007 No.180(P–215), Aug. 9, 1983 & JP 58 082180A (Suwa Seikosha KK) May 17, 1983.

Patent Abstracts of Japan vol. 008 No. 033 (P–254), Feb. 14, 1984 & JP 58 189585 A (Daini Seikosha KK) Nov. 5, 1983.

* cited by examiner

*Primary Examiner*—Bernard Roskoski
(74) *Attorney, Agent, or Firm*—Griffin & Szipl, P.C.

(57) ABSTRACT

The invention concerns a dial (1), in particular for a timepiece, including a plate having at least one recess defining a housing (6) in which a decorative element (8) or suchlike is secured, characterised in that the housing (6) includes a bottom (14) formed of an adhesive strip (16), the adhesive face of which comes into contact with the decorative element (8).

11 Claims, 2 Drawing Sheets

DIAL INCLUDING BRILLIANTS, APPLIQUES OR OTHER APPLIED ELEMENTS AND METHOD FOR SECURING SUCH ELEMENTS THERETO

The present invention concerns a dial including brilliants, appliques or other applied elements and more particularly a watch dial including such decorative elements having a flat base surface. The invention also concerns a method for securing decorative elements applied to a dial.

Watch dials having applied decorative elements, intended to form time signs, on one of their faces, are already known.

A first manufacturing technique for these dials consists in securing the decorative elements, generally cut stones, between two rings each having a seat, and driving the assembly thereby formed into a hole arranged in the dial. Such a technique is described for example in Swiss Patent No. CH 260 123. This technique has the drawback however of requiring the making and handling of numerous parts of very small dimensions, which necessitates skilled labour and leads to high cost prices.

Another conventional technique for securing decorative elements including a flat base surface consists in gluing, using a liquid or semi-liquid glue, the decorative elements via their base surface into recesses made in the thickness of the dial at predetermined locations. Although less expensive than the previous technique, this technique nonetheless has numerous drawbacks.

A first drawback is that it is difficult to glue the decorative elements in an automated manner because of the small dimensions of the decorative elements in question. By way of indication, the brilliants commonly used to form the time signs have diameters of the order of 2 mm. The operations for gluing each decorative element, between one and twelve per dial according to the particular case, must be performed manually, which significantly increases the manufacturing costs of such dials.

A second drawback lies in the fact that it is difficult to determine accurately the quantity of glue to be deposited in each recess to achieve satisfactory adhesion, i.e. adhesion during which the quantity of glue deposited is neither too great, which would be liable to cause an overflow onto the useful face of the dial when the decorative element is set in place, nor insufficient, which would be liable to lead to detachment during subsequent use.

This method is also particularly disadvantageous when such dials are mounted in monoblock watch cases made of plastic closed by an ultrasound welded crystal. Indeed the Applicant has observed that, during welding of the crystal onto the case, the ultrasound vibrations propagate into the glue securing the decorative elements onto the dial, and tend to split the layer of glue and inadvertently separate said decorative elements from their settings.

The known methods thus have general industrialisation problems which need to be overcome.

The main object of the invention is thus to provide a dial, such as a watch dial, including applied decorative elements which is simple and inexpensive to manufacture.

Another object of the invention is to provide a method for securing decorative elements to a dial, this method enabling the decorative elements to be fixed securely to the dial while being easily automated and simple to implement.

The invention thus concerns a dial, in particular for a timepiece, including a plate having at least one housing in which a decorative element or suchlike is secured, characterised in that the housing includes a bottom formed of an adhesive strip, the adhesive face of said strip being in contact with said decorative element.

As a result of these features, the ultrasound vibrations can be dampened by the intrinsic flexible properties of flexibility of the strip and can thus remove the problem of breakage of the layer of glue holding the decorative elements on the dial.

The invention also concerns a method for securing decorative elements on a dial, characterised in that it includes the steps consisting in:

- providing a dial or a plate in which a plurality of dials will be cut;
- making in said dial or said plate, at the locations intended to receive said decorative elements, openings passing through the thickness of the dial or said plate;
- applying an adhesive strip onto the bottom face of the dial or said plate, so that the face of the adhesive strip including the adhesive material is directed towards said openings;
- placing said decorative elements in the openings so that they are glued via one of their faces onto the adhesive face of the strip.

As a result of these features, all the problems of the prior art linked to machining recesses and determining the quantity of glue are eliminated, and the decorative elements can be easily secured simply by applying them to the bottom of the openings of the dial provided for this purpose which is formed by the adhesive face of the strip.

Other advantages and features of the invention will appear more clearly in light of the following description of a preferred embodiment, given by way of non limiting example with reference to the annexed drawings, in which.

Figure 1:
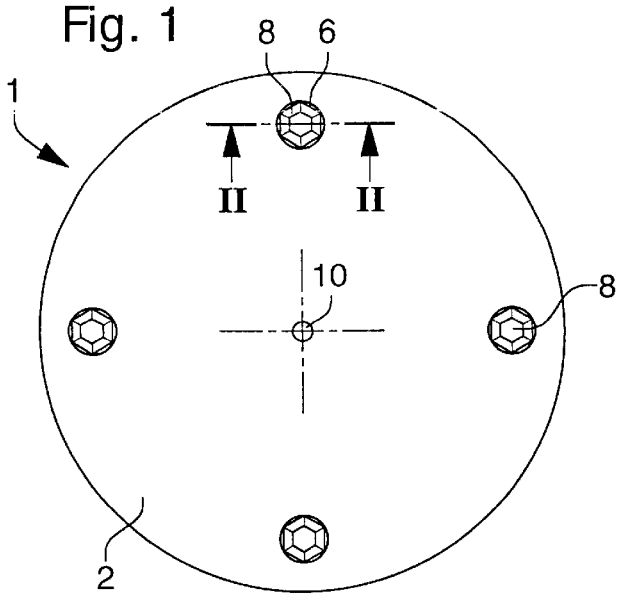
FIG. 1 is a plane view of a dial according to the invention.

With reference first of all to FIG. 1, reference 1 designates a dial formed of a disc made of metal or rigid plastic material including a visible front face 2 and an opposite face 4 called the back face. This disc is typically obtained by stamping a plate, using a die and a punch of appropriate shape. Dial 1 according to the invention includes circular housings 6 on the bottom of which are secured decorative elements 8 appearing on front face 2. Dial 1 also includes in a conventional manner a hole 10 provided for the passage of the hands (not shown).

In the following description, decorative element means a brilliant, applique or any other decorative element which can be applied to a dial and in particular a watch dial. Although in the example illustrated in FIG. 1, decorative elements 8 have been provided respectively at the twelve o'clock, three o'clock, six o'clock and nine o'clock positions to form time signs, it goes without saying that these decorative elements could be placed at any other location on the dial provided that they do not interfere with central hole 10 provided for the passage of the hands.

Figure 2:
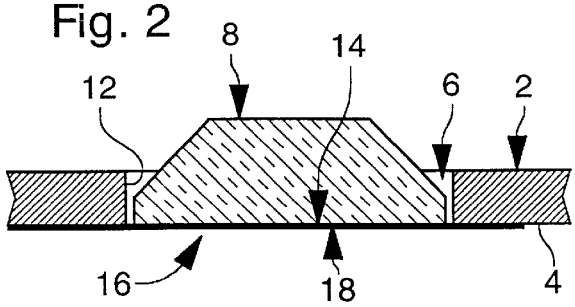
FIG. 2 is a cross-section along the line I—I of FIG. 1.

As is seen in FIG. 2, housings 6 are formed by openings 12 passing right through the thickness of the plate forming dial 1, these openings 12 each being closed by a bottom 14 formed of a portion of adhesive strip 16 glued onto back face 4 of dial 1. Openings 12 have substantially larger dimensions than those of decorative elements 8, which facilitates the setting of decorative elements 8 in housings 6. The adhesive face of strip 16 forming bottom 14 is in close contact with base 18 of decorative element 8 which thus assures the securing of this element 8 onto dial 1.

It will be noted in this regard that it is advantageous to select decorative elements 8 including a substantially flat base 18 in order to increase the surface of element 8 which comes into contact with the adhesive material of strip 16. It will further be noted that it is advantageous to select an adhesive strip 16 having as small a thickness as possible in order not to increase the total thickness of dial 1 given the generally small space available for the latter in a watch case and the general tendency to make watches of relatively small thickness.

In order to provide an indication, the openings typically have a diameter of the order of 2 mm, the dial has a thickness of the order of 0.4 mm and the adhesive strip has a thickness of the order of 0.05 mm.

Adhesive strip 10 is for example a strip known under the commercial name Scotch 850 or Scotch 396 sold by the 3M company or under the commercial name Tesa film 4129 sold by the TESA company.

According to a preferred embodiment, the adhesive strip 16 used is common to the set of housings 6 and for this purpose has a sufficient width to form a bottom 14 simultaneously for all the openings 12 of the dial. For this purpose, strip 16 has a width allowing at least the entirety of back face 4 of dial 1 to be covered.

According to a variant which is not shown, adhesive strip 16 can include adhesive material on both of its faces and thus also assure the holding in place of dial 1 in the watch case.

Figure 3:
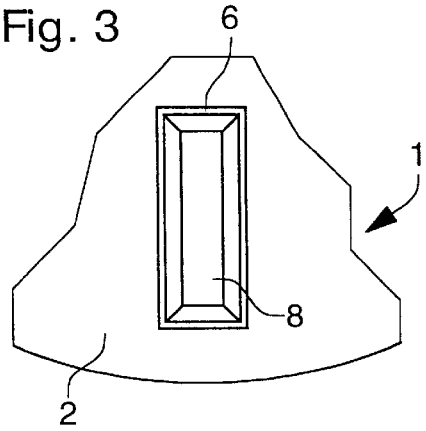
FIG. 3 is a partial plane view of an alternative embodiment of the dial of the invention.
Figure 4:
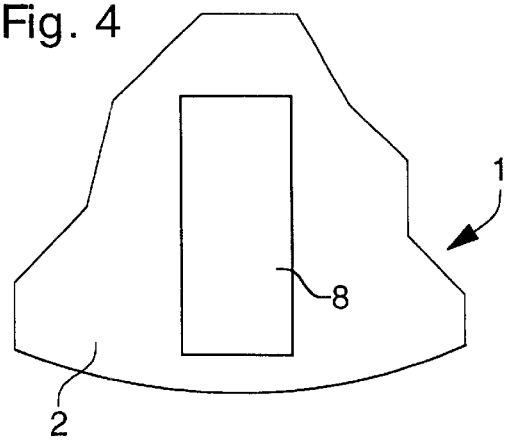
FIG. 4 is a partial plane view of another alternative embodiment of the dial of the invention.
Figure 5:
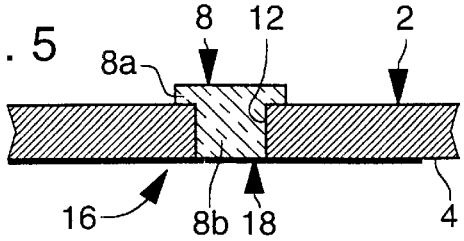
FIG. 5 is a cross-section along the line IV—IV of FIG. 4.

FIGS. 3 to 5 show two alternative embodiments of a dial according to the invention. The elements which are identical to those already described with reference to FIGS. 1 and 2 are designated by the same numerical references.

In the example of FIG. 3, decorative element 8 has the form of a rectangular brilliant housed in a housing 6 of corresponding shape. Brilliant 8 is secured to bottom 14 by means of an adhesive strip 16 glued onto the back face of the dial.

In the example shown in FIGS. 4 and 5, decorative element 8 has the form of a rod with a transverse T shaped cross-section the top part 8*a* of which extends beyond the periphery of opening 12 in which the bottom part 8*b* is housed. This bottom part 8*b* includes a flat bottom 18 which comes into close contact with the adhesive face of adhesive strip 16 glued to back face 4 of dial 1. Rod 8 Is for example made of silver plated plastic material, ceramics or suchlike and advantageously forms time signs having an original appearance. This embodiment has the advantage of being able to mask the free space between decorative element 8 and the edge of opening 12 which is normally visible in the case of dials including decorative elements such as brilliants or suchlike.

Figure 6:
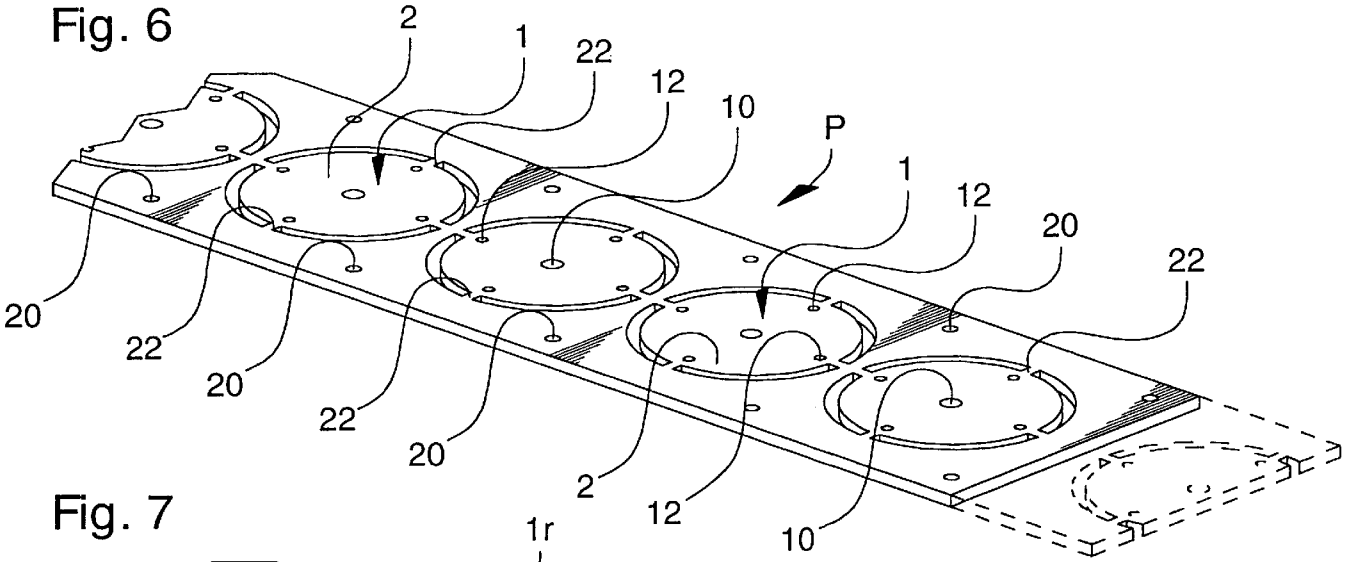
FIG. 6 is a perspective view of a plate in which a plurality of dials according to the invention are stamped, the plate being shown prior to gluing of the adhesive strip.
Figure 7:
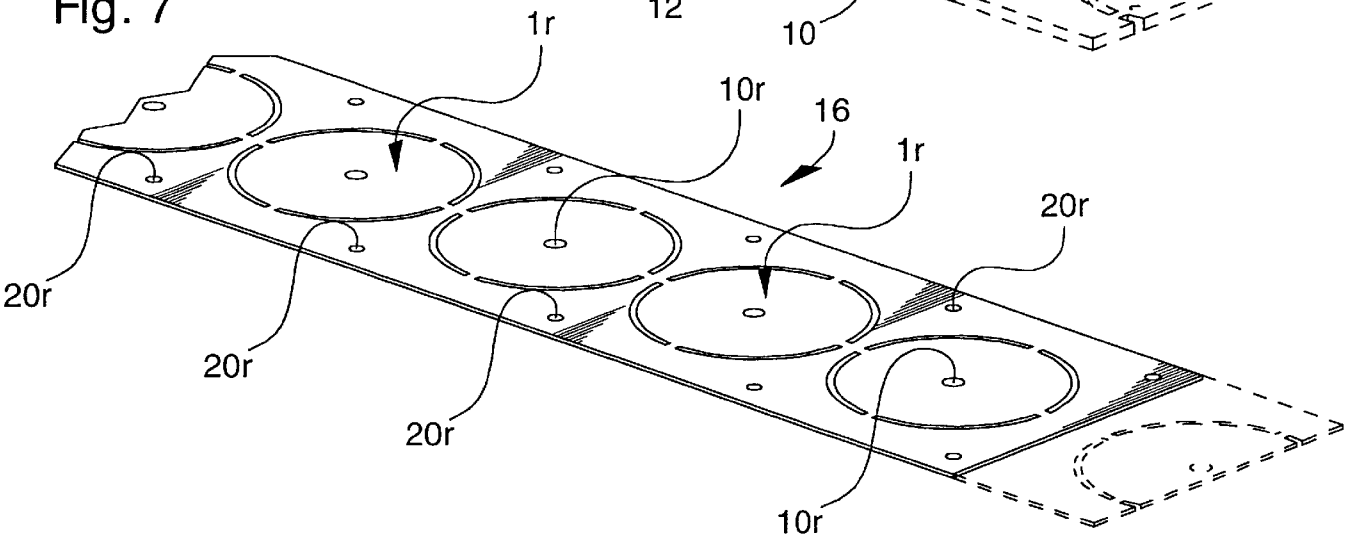
FIG. 7 is a perspective view of a stamped adhesive strip according to the invention prior to gluing onto the plate including the dials.

The method for securing decorative elements to a dial according to the invention will now be described with reference to FIGS. 6 and 7.

Plate P (FIG. 6) in which a plurality of dials will be stamped is for example cut from a coil (not shown) and provided to a conventional stamping station which is also not shown.

During a first step, openings 12 passing right through the thickness of the plate (FIG. 6) are made by stamping in plate P, at the locations intended to receive decorative elements 8. Plate P includes a determined number of dials, typically a half-dozen.

In this particular case, the punch and the die are provided to form simultaneously during stamping of openings 12, a hole 10 substantially at the centre of each dial 1, to allow the subsequent passage of canon pipes to which the hands of the timepiece, to which the dials are intended to be fitted, will be secured. Indexing and driving perforations 20 are also provided allowing accurate positioning of the plate to be assured for subsequent operations and perforations for positioning the dial in the watch case. These perforations are conventionally arranged at six o'clock on the edge of the dial.

It will also be noted that dials 2 are cut into plate P, so that each of these substrates is connected to the rest of the plate by four bridges of material 22. The number and dimensions of bridges of material 22 vary as a function of the shape and the material of which the dial is made. Typically, the bridges are such that they allow easy subsequent removal of the dials from the strip, for example by simple pressure thereon.

According to a variant, one could also envisage using a technique called resetting the stamped dials in the strip, i.e. replacing dials 1 in plate P at the locations where they were cut out, dials 1 being held in plate P by microwelds which are spontaneously created when the stamped part is driven into the location in plate P from which it came.

It goes without saying that other cutting means could be envisaged. Laser beam cutting and high pressure water jet cutting will be mentioned in particular in this regard.

During a parallel step, adhesive strip 16, which will subsequently be glued to back face 4 of dials 1, is prepared. In order to do this, a section of strip 16 is cut from a roll which feeds a stamping station. The length and the width of the section of strip 16 correspond to those of plate P. In the stamping station shapes corresponding to those of dials 2 cut in plate P, are cut, with exception of openings 12. These shapes are of course cut in an arrangement and number corresponding to those made on plate P. In FIG. 7 the different elements of strip 16 corresponding to those of plate P have been designated by the same numerical reference classified with the letter r.

During a following step, adhesive strip 16 is applied to the back face of plate P, so that the face of this strip 16 including the adhesive material is directed towards openings 12. The application of strip 16 can of course be achieved automatically.

In the last step of the method, decorative elements are placed in bottom 14 of openings 12 and a slight pressure is applied thereto so that they come into close contact with the adhesive face of strip 16 via one of their faces and thus the securing thereof by gluing in housings 6 of dials 2 is assured. The setting in place of decorative elements 8 is preferably performed automatically.

It goes without saying that the steps which have just been described apply to the treatment of individual dials.

The essential advantage of the method described hereinbefore lies in the fact that it is particularly simple, so that it can easily be automated. Moreover, tests conducted by the Applicant have led to results confirming the reliability of the securing of decorative elements 8 to dial 2. The waste levels of dials made in this way have been able to be reduced significantly with respect to the securing techniques of the prior art.

What is claim is:

1. A dial, in particular for a timepiece, having a back face and including a plate having at least one housing in which a plurality of decorative elements are secured, wherein the housing includes a bottom formed of an adhesive strip having an adhesive face and a sufficient width to receive the entirety of the back face of the dial so that the adhesive face of said strip is in contact with each decorative element.

2. A dial according to claim 1, wherein the housing is formed by an opening made right through the thickness of the dial, the opening being closed by the adhesive strip glued to the back face of the dial.

3. A dial according to claim 1, wherein the decorative element or elements have a bottom at least a part of which is substantially flat.

4. A dial according to claim 1, wherein said openings have substantially larger dimensions that those of the decorative elements.

5. A dial according to claim 1, wherein the adhesive strip includes adhesive material on its two faces.

6. A dial according to claim 1, wherein the thickness of the adhesive strip is of the order of 50 micrometers.

7. A dial according to claim 2, wherein the decorative element or elements have a bottom at least a part of which is substantially flat.

8. A method for securing decorative elements on a dial, including the steps of:

a dial or a plate in which a plurality of dials will be cut;

making in said dial or said plate, at the locations intended to receive said decorative elements, openings passing through the thickness of said dial or said plate;

applying an adhesive strip onto the bottom face of said dial or said plate, so that the face of the adhesive strip including the adhesive material is directed towards said openings;

placing said decorative elements in the openings so that they are glued via one of their faces to the adhesive face of the strip.

9. A securing method according to claim 8, wherein the openings are formed by stamping.

10. A securing method according to claim 8, wherein, prior to the adhesive strip application step, it includes a step for stamping the adhesive strip to give it a shape corresponding to that of the dial with the exception of said openings.

11. A securing method according to claim 9, wherein prior to the adhesive strip application step, it includes a step for stamping the adhesive strip to give it a shape corresponding to that of the dial with the exception of said openings.

* * * * *